US008228235B2

(12) United States Patent
Habib et al.

(10) Patent No.: US 8,228,235 B2
(45) Date of Patent: Jul. 24, 2012

(54) HIGH GAIN ANTENNA FOR MICROWAVE FREQUENCIES

(75) Inventors: Laurent Habib, Moshav Shapira (IL); Claude Samson, Rehovot (IL)

(73) Assignee: Elta Systems Ltd., Ashdod (IL)

( * ) Notice: Subject to any disclaimer, the term of this patent is extended or adjusted under 35 U.S.C. 154(b) by 292 days.

(21) Appl. No.: 11/338,883

(22) Filed: Jan. 25, 2006

(65) Prior Publication Data

US 2006/0170596 A1 Aug. 3, 2006

Related U.S. Application Data

(63) Continuation-in-part of application No. 10/800,019, filed on Mar. 15, 2004, now Pat. No. 7,023,386.

(51) Int. Cl.
*H01Q 1/38* (2006.01)

(52) U.S. Cl. ..... 343/700 MS

(58) Field of Classification Search ..... 343/700 MS, 343/793, 795, 805, 810, 814, 816, 820, 822, 343/853, 803, 806, 850
See application file for complete search history.

(56) References Cited

U.S. PATENT DOCUMENTS

| | | | | |
|---|---|---|---|---|
| 3,887,925 | A * | 6/1975 | Ranghelli et al. | 343/795 |
| 4,543,579 | A * | 9/1985 | Teshirogi | 342/365 |
| 4,943,811 | A * | 7/1990 | Alden et al. | 343/814 |
| 5,382,959 | A * | 1/1995 | Pett et al. | 343/700 MS |
| 5,661,494 | A * | 8/1997 | Bondyopadhyay | 343/700 MS |
| 5,708,446 | A | 1/1998 | Laramie | |
| 5,786,793 | A | 7/1998 | Maeda et al. | |
| 5,995,821 | A * | 11/1999 | Tran | 455/345 |
| 6,037,911 | A | 3/2000 | Brankovie et al. | |
| 6,163,306 | A | 12/2000 | Nakamura et al. | |
| 6,166,702 | A | 12/2000 | Audenaerde | |
| 6,275,192 | B1 | 8/2001 | Kim | |
| 6,285,323 | B1 | 9/2001 | Frank | |
| 6,424,311 | B1 | 7/2002 | Tsai | |
| 6,518,935 | B2 * | 2/2003 | Louzir et al. | 343/853 |
| 6,535,169 | B2 * | 3/2003 | Fourdeux et al. | 343/700 MS |

(Continued)

FOREIGN PATENT DOCUMENTS

| | | |
|---|---|---|
| EP | 0 920 074 A1 | 8/1999 |
| EP | 1 271 692 A1 | 1/2003 |
| WO | WO 01/80358 A1 | 10/2001 |

OTHER PUBLICATIONS

Lo, Y.T.; "Antenna Handbook, vol. II Antenna Theory"; Van Nostrand Reinhold, New York.

(Continued)

*Primary Examiner* — Tan Ho
(74) *Attorney, Agent, or Firm* — Browdy and Neimark, PLLC

(57) ABSTRACT

The present invention provides for an antenna and a method for providing an antenna for transmitting and/or receiving electromagnetic waves of at least one predefined frequency and a circular polarization, the antenna comprising at least a first support having upper and lower faces and at least one pair of substantially identical upper and lower radiating elements disposed on the upper and lower faces, respectively, each radiating element being capable of transmitting and/or receiving electromagnetic waves of circular polarization with a phase center located at a predefined position.

14 Claims, 14 Drawing Sheets

U.S. PATENT DOCUMENTS

| | | | | |
|---|---|---|---|---|
| 6,844,851 | B2 * | 1/2005 | Yoon et al. | 343/700 MS |
| 6,856,300 | B2 * | 2/2005 | McCarrick | 343/853 |
| 6,930,639 | B2 * | 8/2005 | Bauregger et al. | 343/700 MS |
| 6,982,672 | B2 * | 1/2006 | Lin et al. | 343/700 MS |
| 2003/0020665 | A1 | 1/2003 | Shor | |
| 2003/0063031 | A1 | 4/2003 | Wong et al. | |
| 2003/0218571 | A1 | 11/2003 | Yoon et al. | |

OTHER PUBLICATIONS

Sasas Dragas and Marco Sabbadini; "A Novel Type of Wide Band Circular Polarised Antenna"; Proceedings ESA WPP-222;27$^{th}$ ESA Antenna Workshop on Innovative Periodic Antennas; Electromagnetic Bandgap, Lefthanded Material, Fractal and Frequency Selective Surfaces. Mar. 9-11, 2004, Santiago de Compostela.

* cited by examiner

HIGH GAIN ANTENNA FOR MICROWAVE FREQUENCIES

FIELD OF THE INVENTION

This invention relates generally to the field of high-frequency antennas and particularly to the field of planar and conformal antennas for high frequency microwaves.

BACKGROUND OF THE INVENTION

Planar (or flat-plate) and conformal antennas for high frequency microwave transmission (e.g. in various parts of 0.1-40 GHz range) are nowadays widely in use, for example in radio broadcasting, mobile communication, and satellite communication. Such antennas can provide circular and linear polarization, based on their specific configurations.

Generally, printed conformal and planar antennas are built on a multilayered substrate structure (e.g. PCB, printed circuit board) and include, inter alia, a dielectric substrate and an array of radiating elements and their respective transmission lines, the number of elements depending on their gain as well as on the overall desired gain of the antenna. The radiating elements and the transmission lines are disposed on either one or both sides of the dielectric substrate. Planar antennas are produced, for example, by printing using so-called "microstrip" technology or photolithography.

U.S. Pat. No. 6,285,323 discloses a flat panel antenna for microwave transmission that comprises at least one PCB, and has radiating elements and transmission lines located on both the first and second sides of the PCB in a complementary manner, such that the transmission lines of the first and second sides overlay one another, and the radiating elements of the second side extend outwards from the terminations of the transmission lines in the opposite directions, at an angle of 180 degrees from the radiating elements of the first side.

US Patent Application No. 2003/0218571 discloses an antenna having linear and circular polarization, which uses dipoles as radiating elements, and has an orthogonal characteristic in both linear and circular polarization, the antenna being embodied in the use of two plates, including the front and rear sides of both plates.

US Patent Application No. 2003/0020665 discloses a planar antenna having a scalable multi-dipole structure for receiving and transmitting high-frequency signals, including a plurality of opposing layers of conducting strips disposed on either side of an insulating (dielectric) substrate.

U.S. Pat. No. 6,163,306 discloses a circularly polarized cross dipole antenna comprising a first L-shaped dipole antenna element including a first pair of strip conductors and a first bending portion and a second L-shaped dipole antenna element including a second pair of strip conductors and a second bending portion. The first L-shaped dipole antenna element is arranged in a first region of four regions delimited by crossing lines virtually set within a single plane and the second L-shaped dipole antenna element is arranged in a second region thereof, which is diagonally opposite to the first region. The first bending portion and the second bending portion are close and opposite to each other, such that the first and second L-shaped dipole antenna elements form a cross. The antenna also comprises a parallel-twin-line feeder extending from the first and second bending portions and provided so as to feed power within the single plane.

Also related to planar antennas are U.S. Pat. Nos. 5,708,446, 5,786,793,6,037,911, 6,166,702, 6,275,192, 6,424,311, 6,518,935, 6,844,851; US Patent Application No. 2003/0063031; PCT Patent Application No. WO01/80358; EP Patent Applications Nos. EP0920074 and EP1271692; and SASAS DRAGAS and MARCO SABBADINI: "A Novel Type of Wide Band Circular Polarised Antenna (Proceedings ESA WPP-222; 27$^{th}$ ESA Antenna Workshop on Innovative Periodic Antennas, Electromagnetic Bandgap, Lefthanded Materials, Fractal and Frequency Selective surface, 9-11 Mar. 2004, Santiago de Compostela.

There is a need in the art for a new planar/conformal antenna.

SUMMARY OF THE INVENTION

The present invention provides for planar and conformal antennas for transmitting and/or receiving electromagnetic waves of at least one predefined frequency in the range of 0.1-40 GHz, and a predefined polarization. The antenna according to the invention provides both circular and linear polarization, based on its specific predefined configuration.

According to an embodiment of the invention there is provided a planar or conformal antenna for transmitting and/or receiving electromagnetic waves of at least one predefined frequency and a predefined polarization, the antenna comprising a plane dielectric substrate (PCB) with upper and lower faces; at least one pair of substantially identical upper and lower radiating elements disposed on said upper and lower faces; in each pair of said radiating element in the upper face and the corresponding radiating element in the lower face, the phase center of the lower radiating element substantially coincides with the phase center of the upper radiating element. This allows for high level of antenna performance, e.g. gain of at least 1 dB, 1.5 dB and more, up to 3 dB, when compared to a prior art antenna with the same number of radiating elements, having substantially the same geometrical dimensions; and low axial ratio over a large portion of the radiated beam.

According to an embodiment of the invention, the antenna is configured for providing circular polarization, and each of the radiating elements is capable of radiating electromagnetic waves of a circular polarization. According to another embodiment of the invention, the radiating elements comprise bend-shaped elements. According to yet another embodiment of the invention, the above-mentioned bend-shape is an L-shape.

According to an embodiment of the invention, the antenna is configured for providing linear polarization, and the radiating elements comprise radiating elements having first and second branches arranged at an acute angle with respect to each other.

According to an embodiment of the invention there is provided an antenna for transmitting and/or receiving electromagnetic waves of at least one predefined frequency and a predefined polarization, the antenna comprising a multi-layered substrate structure having a dielectric substrate with upper and lower faces; at least one pair of substantially identical upper and lower radiating elements disposed on said upper and lower faces of the dielectric substrate; each radiating element transmitting and/or receiving electromagnetic waves with a phase center located at a predefined position; each radiating element comprising a radiating element and a transmission line, the geometrical dimensions of which depend on said predefined frequency; in each pair of said radiating element in the upper face and the corresponding radiating element in the lower face:

- the transmission lines of the upper and lower elements overlay each other; and
- the radiating elements of the upper and lower elements are located opposite to each other with respect to a plane perpendicular to the plane of the dielectric substrate, such that the phase center of the lower radiating element substantially coincides with the phase center of the upper radiating element.

According to yet another embodiment of the invention there is provided a method for providing a planar antenna for transmitting and/or receiving electromagnetic waves of at least one predefined frequency and a predefined polarization, the antenna having a dielectric substrate with upper and lower faces; at least one pair of substantially identical upper and lower radiating elements disposed on said upper and lower faces of the dielectric substrate; said radiating elements comprising radiating elements having first and second branches the method comprising:

determining the planar arrangement and the geometrical dimensions of said first and second branches in accordance with said predefined polarization and said at least one predefined frequency; and associating each of the radiating elements in the upper face with a corresponding radiating element in the lower face, such that the phase center of the lower radiating element substantially coincides with the phase center of the upper radiating element.

According to one embodiment of the invention there is provided an antenna for transmitting and/or receiving electromagnetic waves of at least one predefined frequency and a circular polarization, the antenna comprising at least a first support having upper and lower faces and at least one pair of substantially identical upper and lower radiating elements disposed on said upper and lower faces, respectively, each radiating element being capable of transmitting and/or receiving electromagnetic waves of circular polarization with a phase center located at a predefined position.

According to another embodiment of the invention there is provided an antenna for transmitting and/or receiving electromagnetic waves of at least one predefined frequency and a circular polarization, the antenna comprising at least a first support having upper and lower faces and at least one pair of substantially identical upper and lower radiating elements disposed on said upper and lower faces, respectively, each radiating element being capable of transmitting and/or receiving electromagnetic waves of circular polarization with a phase center located at a predefined position, and the radiating elements on each face of said first and second supports are arranged such that the distance between the phase centers of at least one pair located on the first support and another, adjacent pair located on the second support is in a range of about $0.4\lambda 0$-$0.5\lambda 0$, $\lambda 0$ being the wavelength of the predefined frequency in air.

According to yet another embodiment of the invention there is provided an antenna for transmitting and/or receiving electromagnetic waves of at least one predefined frequency and a predefined polarization, the antenna comprising a multi-layered substrate structure having at least a first and second dielectric substrate layer each having at least an upper and a lower face; each face carrying at least one radiating element capable of transmitting and/or receiving electromagnetic waves of circular polarization with a phase center located at a predefined position; at least a first radiating element carried on one face is paired with at least a second radiating element carried on a different face and oppositely located with respect to a plane perpendicular to the plane of the dielectric substrates, such that the phase center of the first radiating element substantially coincides with the phase center of the at least radiating element.

According to an embodiment of the present invention there is provided a method for providing a planar antenna for transmitting and/or receiving electromagnetic waves of at least one predefined frequency and a required linear polarization, the antenna having at least a first and second dielectric substrate, at least one face of each substrate carrying at least one radiating element capable of transmitting and/or receiving electromagnetic waves of circular polarization with a phase center located at a predefined position, the method comprising:

pairing said radiating element with a corresponding, substantially identical radiating element carried on a different face, by having the phase center of the corresponding radiating element substantially coinciding with the phase center of said radiating element, thereby constituting a pair of radiating elements;

electronically associating said pair of radiating elements with at least one additional pair of radiating elements by determining the spatial arrangement of said pairs in accordance with said required linear polarization and said predefined frequency, such that the required linear polarization is obtained by assigning one pair with electromagnetic waves of right-hand circular polarization and the other pair with electromagnetic waves of left-hand circular polarization.

According to another embodiment of the present invention there is provided an antenna for transmitting and/or receiving electromagnetic waves of at least one predefined frequency and a circular polarization, the antenna comprising at least a first and second support, each with upper and lower faces, and at least one, first radiating element disposed on at least the upper or lower faces of the first support, and at least a second radiating element disposed on at least the upper or lower faces of the second support; said first and second radiating elements are capable of transmitting and/or receiving electromagnetic waves of a circular polarization with a phase center located at a predefined position such that the phase center of the first radiating element substantially coincides with the phase center of the second radiating element.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF SPECIFIC EMBODIMENTS OF THE INVENTION

Figure 1:
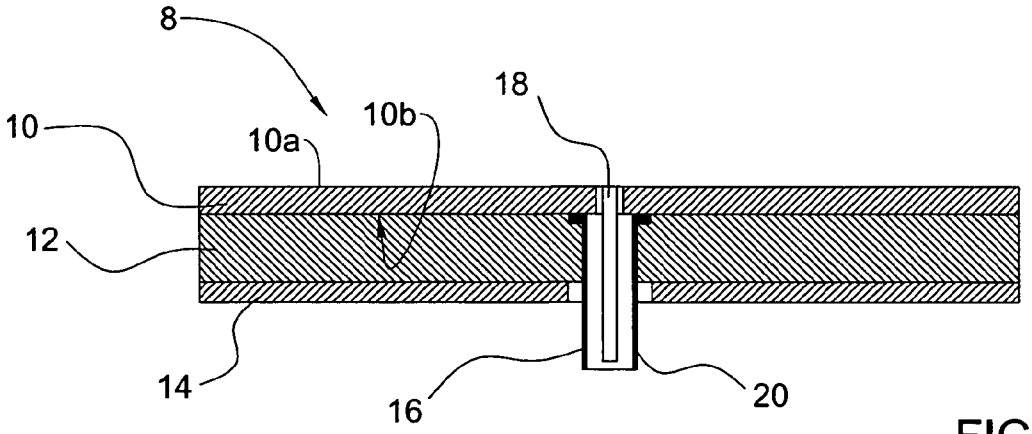
FIG. 1 is a cross-sectional view of a flat microwave antenna according to an embodiment of the invention.

FIG. 1 is a general cross-sectional view of a flat microwave antenna 8 for high frequency microwave transmission (e.g. in various parts of 0.1-40 GHz range). The antenna 8 has a multilayer structure and comprises, inter alia, at least one PCB (Printed Circuit Board) 10 made of a dielectric material, e.g. PTFE Glass fiber type RT/duroid™ 5880 commercially available from Rogers Corporation, Arizona, USA, having relative permittivity $\in_r$=2.2. The PCB 10 has two faces, 10*a* (upper face) and 10*b* (lower face) on which radiating elements (not shown in FIG. 1), made of an electrically conductive material, are disposed. The antenna 8 further comprises spacer layer 12 made of a low relative permittivity (e.g. foam, typically having $\in_r$=1.05, air, having $\in_r$=1.00) and a ground plate 14, typically made of a metallic material. Additional layers (not shown in FIG. 1) can also be used, as known in the field of antennas, such as a mounting plate, a polarizer layer, a box, etc. Discrete spacers can be used instead of spacer layer 12. Electrical coaxial connector 16 having pin 18 and sleeve 20 is used to feed the antenna. Note that the invention is not bound by the general structure of a planar antenna as exemplified in FIG. 1. For example, antenna 10 may be a conformal antenna, which conforms to a surface whose shape is determined by considerations other than electromagnetic, for example, aerodynamic or hydrodynamic.

Figure 2:
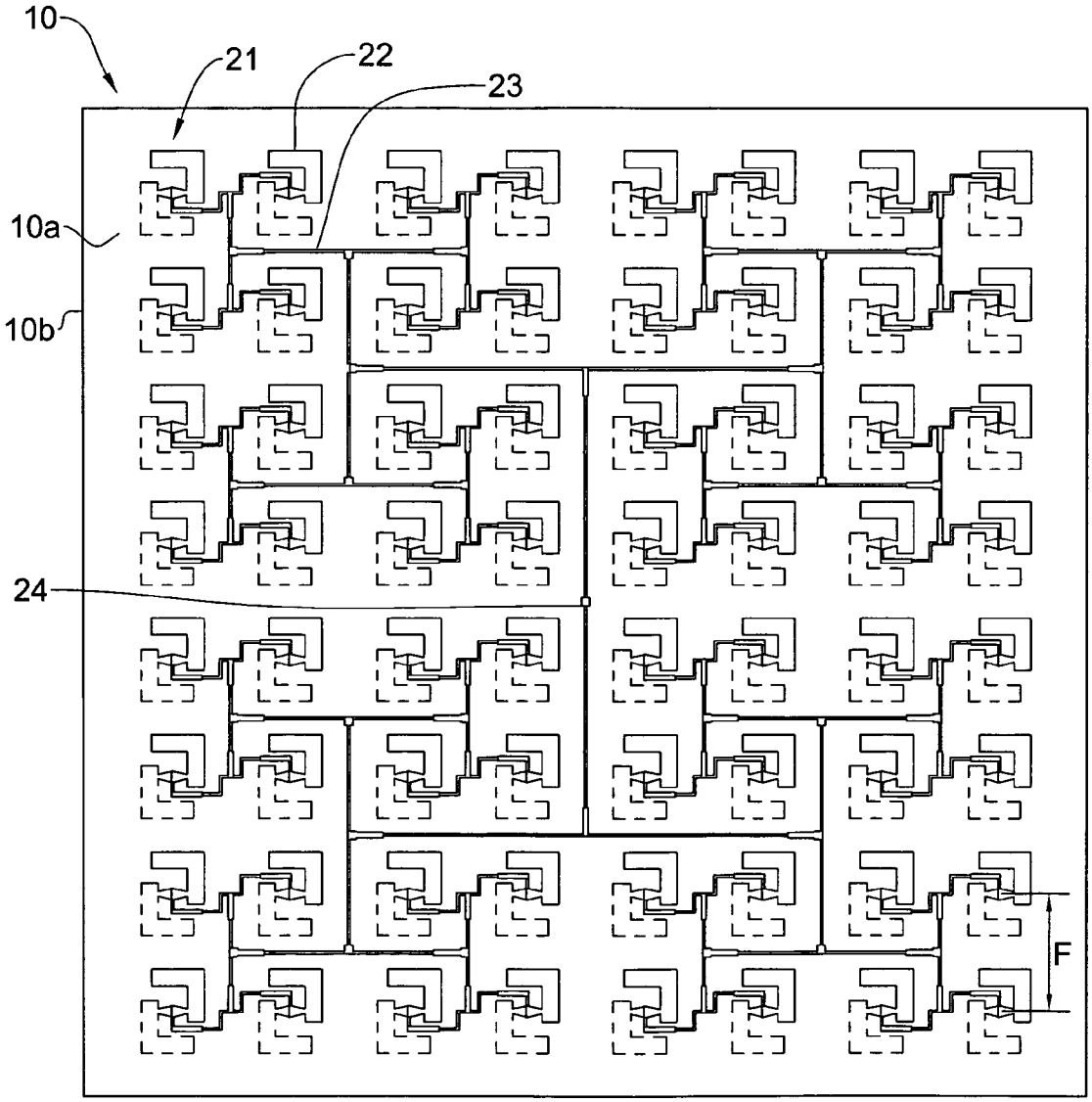
FIG. 2 is a top view of an antenna according to an embodiment of the invention.

FIG. 2 is a top view of the upper face 10*a* of the PCB 10 of the antenna 8 according to an embodiment of the invention, suitable for circular polarization. As shown in FIG. 2 in an exemplary manner, a plurality of radiating elements 21 is disposed in a specific configuration on face 10*a*. The radiating elements 21 are substantially identical and each comprises a bend-shaped element 22 and a co-planar transmission line 23 (both marked in FIG. 2 in full lines). A plurality of substantially identical radiating elements 21 is disposed on face 10*b*. Each of the radiating elements 21 disposed on face 10*a* is paired with a corresponding radiating element disposed on face 10*b* in a complementary manner that will be discussed in further detail below. The transmission lines of the paired radiating elements substantially overlay each other (the so-called "twin line" configuration) and thus the transmission lines 23 disposed on face 10*b* are not shown in FIG. 2. The bend-shaped elements 22 disposed on face 10*b* are marked in dashed line. The radiating elements on both faces are disposed in a substantially symmetrical manner around the feed structures 16, 18 and 20. The use of "twin line" configuration as well as the symmetrical positioning of the elements around the feed structures ensures the same input impedance of all radiating elements and balanced distribution of energy throughout the array.

In the non-limiting example of FIG. 2, the antenna comprises an array of 8×8 pairs of radiating elements. Note that the invention is not limited by this specific example and many other array configurations are possible, as the case may be and typically, the number of pairs of radiating elements is set to provide a certain desired gain. According to some embodiments, only one pair of radiating elements may be used. Also, note that the invention is not bound by the specific layout and configuration of the radiating elements as exemplified in FIG. 2.

Figure 3A:
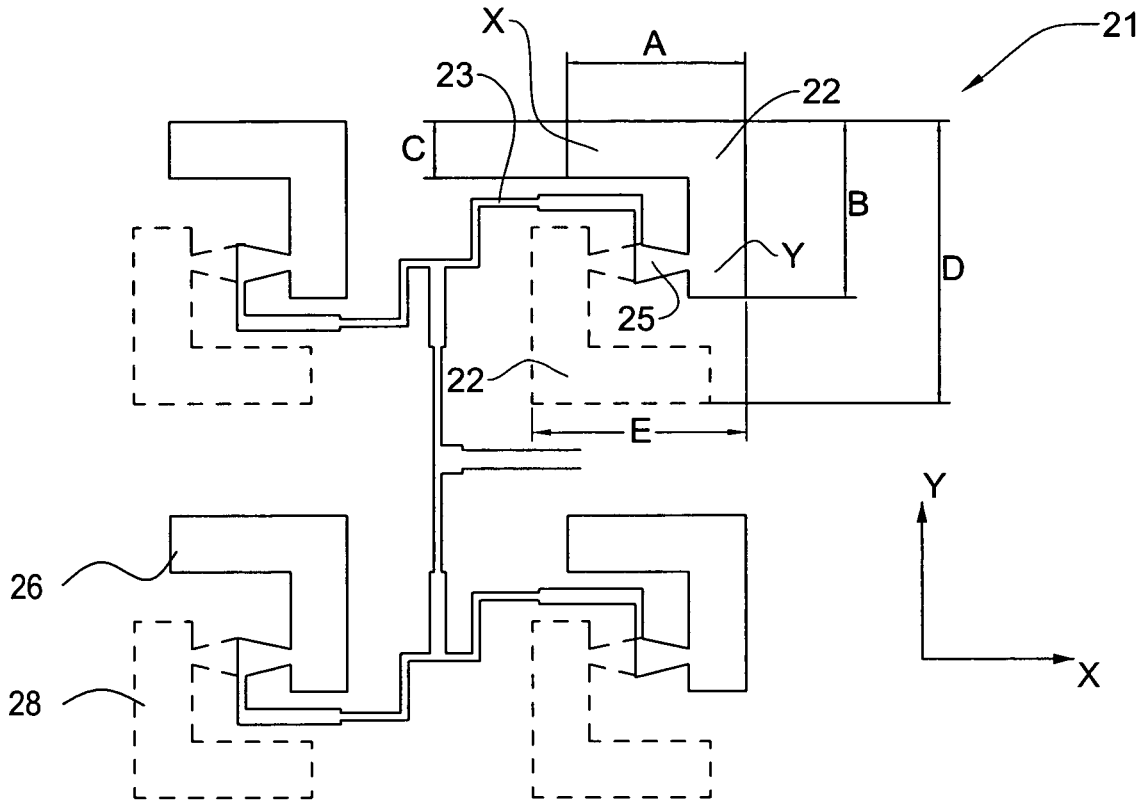
FIGS. 3*a*-3*b* are schematic illustrations of the structure of an element of the antenna of FIG. 2, from top and side views, respectively.
Figure 3B:
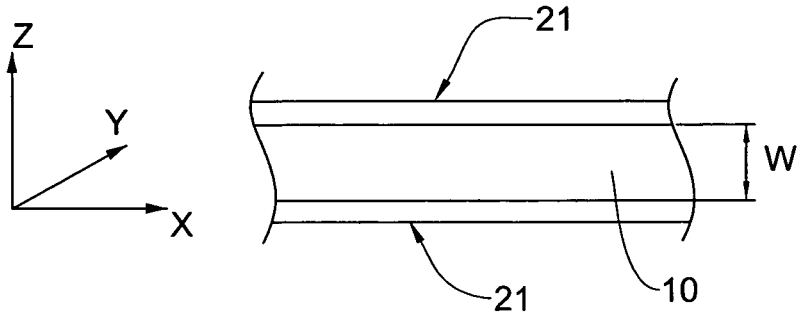

FIGS. 3*a*-3*b* illustrate schematically in greater detail the structure of paired radiating elements 21 of the antenna of FIG. 2, suitable for circular polarization in the frequency range of 8-9 GHz, from top and side views, respectively. Same elements are given same reference numbers. As shown in FIG. 3*a*, each of the radiating elements 21 comprises a bend-shaped element 22 connected to a transmission line 23 via feed point 25. As will be explained in greater detail further below, each of the radiating elements 21 is designed to be capable of radiating electromagnetic waves of a circular polarization, and the paired elements 21 are aligned with respect to each other in a relatively compact spatial arrangement, in a predefined manner, such that high level of antenna performance, e.g. gain up to 3 dB, is achieved, compared to a prior art antenna with the same number of radiating elements having substantially the same geometrical dimensions. Thus, each pair of the substantially identical upper and lower radiating elements disposed on the upper and lower faces yields gain increase in the range of 1 dB to 3 dB and provides gain in the range of 6 dB to 9 dB and more (this is demonstrated e.g. in FIG. 5*a*).

The following is a description of the design of a single radiating element in the circular polarization configuration, in accordance with an embodiment of the invention. In the following example, the PCB material has relative permittivity $\in_r$=2.2 and width w=0.5 mm. Note that the invention is not bound by the following example.

As demonstrated in the non-limiting example of FIG. 3*a*, the antenna operates in a frequency of 8 GHz (this being the desired operating center frequency) and an L-shaped element 22 is used, having orthogonal branches X and Y disposed on the plane of the PCB 10. The geometrical dimensions of the L-shaped branches are as follows:

The lengths A and B of the X and Y branches are substantially identical and are defined by the following equation:

$$A,B=K_1\lambda_0 \quad [1]$$

Wherein $K_1$ is in the range of 0.3 to 0.35, e.g. $K_1$=0.33, and wherein $\lambda_0$ is the wavelength of the operating frequency in air. Thus, in the abovementioned operating frequency (8 GHz), A and B equal 12.5 mm.

The width C of the X and Y branches is defined as follows:

$$C=K_2\lambda_0 \quad [2]$$

Wherein $K_2$ is in the range of 0.10 to 0.20, e.g. $K_2$=0.106. In the example of FIG. 3*a* (operating frequency of 8 GHz), C equals 4 mm.

The feed point 25 is connected to one of the branches, the Y branch in the example of FIG. 3*a*. The location of the connection determines the delay between the current components propagating along the X and Y branches and is set to generate a phase delay of 90° between the components in order to provide circular polarization.

Figure 4A:
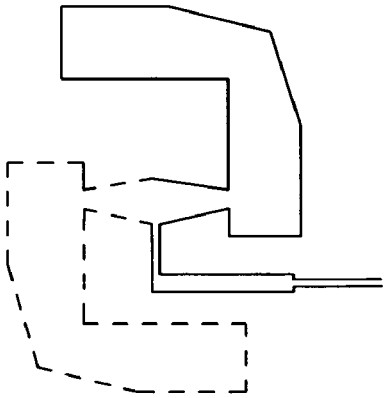
FIGS. 4*a*-4*d* are schematic illustrations of the structure of elements of the antenna of FIG. 2, in accordance with a few other embodiments of the invention.
Figure 4B:
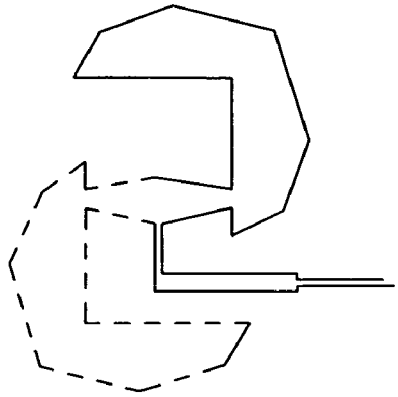
Figure 4C:
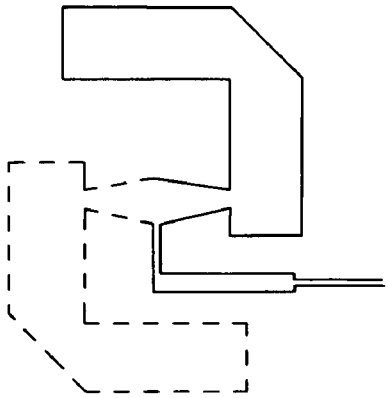
Figure 4D:
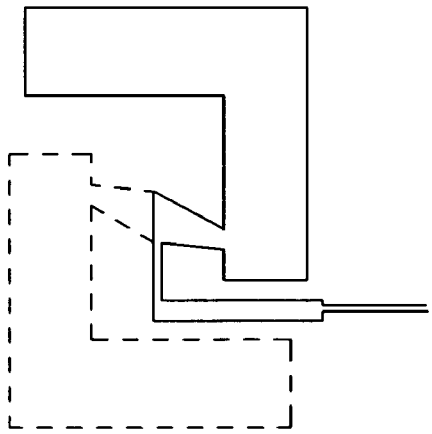

It should be noted that the invention is not limited by the specific example of the radiating element 21 as shown in FIG. 3*a*, and many others are possible, for example the elements illustrated in FIGS. 4*a*-4*b*, each having a substantial bend-shape. Note that the shape of the bend-shaped elements need not have straight-line contour, and any version of bend-shape element can be used, including a smooth shape.

According to an embodiment of the present invention, the radiating element is configured for generating electromagnetic field with circular polarization and for that purpose it has a substantially L-shape with first and second branches and a feed point located on said second branch, such that the electric current generated in the second branch is phase delayed in 90° with respect to the electric current generated in the first branch.

Having described the design of a single radiating element, there follows a description of the design of a paired radiating element in the circular polarization configuration, according to an embodiment of the invention:

As mentioned before, the paired elements 21 disposed on both the upper and lower faces of the PCB 10 are oppositely aligned in a relatively compact space, in a complementary manner, such that the phase centers of the upper and lower elements substantially coincide, yielding a high level of antenna performance. According to an embodiment of the invention, the upper and lower elements are oppositely and adjacently aligned in the following manner:

Length D between the X branch of said upper radiating element and the X branch of said lower radiating element, and the length E between the Y branch of said upper radiating element and the Y branch of said lower radiating element, are defined by the following equations:

$$D=K_3\lambda_0 \quad [3]$$

$$E=K_4\lambda_0 \quad [4]$$

Wherein $K_3$ and $K_4$ are in the range of 0.3 to 0.6, e.g. $K_3$ and $K_4$ equal 0.41 $\lambda_0$. Note that D and E need not be identical. Also note that upper and lower radiating elements need not be in full symmetry with each other. Note that D and E values other than the above specified values can be used. For example, in the case D or E exceeds $0.6\lambda_0$, the gain of the antenna may increase due to the increase in the equivalent surface of the antenna. However the axial ratio (the measure of the antenna circularity on its axis of symmetry) is increased.

According to the present invention and as illustrated in FIGS. 2 and 3*a*, the phase centers of the upper and lower radiating elements substantially coincide with each other. In case the paired elements are arranged in an array (as shown in FIG. 2), a length F between the phase centers of adjacent pairs must be kept at a certain range as follows:

$$0.5\lambda_0<F<1\lambda_0 \quad [5]$$

In the above discussion with reference to FIGS. 2 and 3*a*-3*b*, the relative alignment of the paired elements 21 is presented in two dimensions only, namely with respect to the X and Y axis that define the plane of the PCB 10. However, the relative alignment of the paired element 21 is actually defined in three-dimensions, i.e. onto the plane of the PCB 10 and also along the orthogonal Z axis. Due to the very small width w of the PCB 10 (as shown in FIG. 3*b*), typically about 0.1-0.5 mm, it is possible to disregard the relative alignment considerations along the Z axis and to define the relative alignment of the paired elements in two-dimensions only. The width w of the PCB 10 needs to be very small with respect to λ, the wavelength corresponding to the operating frequency of the antenna, e.g. less than 0.05λ or 0.1λ or more, otherwise the relative alignment of the paired element should be defined in three dimensions.

The phase center of an antenna can be determined by measurements, computed simulations, and calculations. As discussed in "Antenna Handbook, Volume II Antenna Theory", ed. Y. T. Lo, Van Nostrand Reinhold, New York, in chapter 8, the analytical formulations for locating the phase center of an antenna typically exist for only a limited number of antenna configurations. Experimental techniques are known in the art for locating the phase center of an antenna, as well as simulation tools such as the CST Microwave Studio™ software commercially available from CST Computer Simulation Technology GmbH, Germany.

FIGS. 5*a*-5*e* illustrate simulated characteristics of a pair of radiating elements according to an embodiment of the invention, in the circular polarization configuration shown in FIG. 3*a*, relating to operating frequencies in the range of 8-9 GHz, as follows.

Figure 5A:
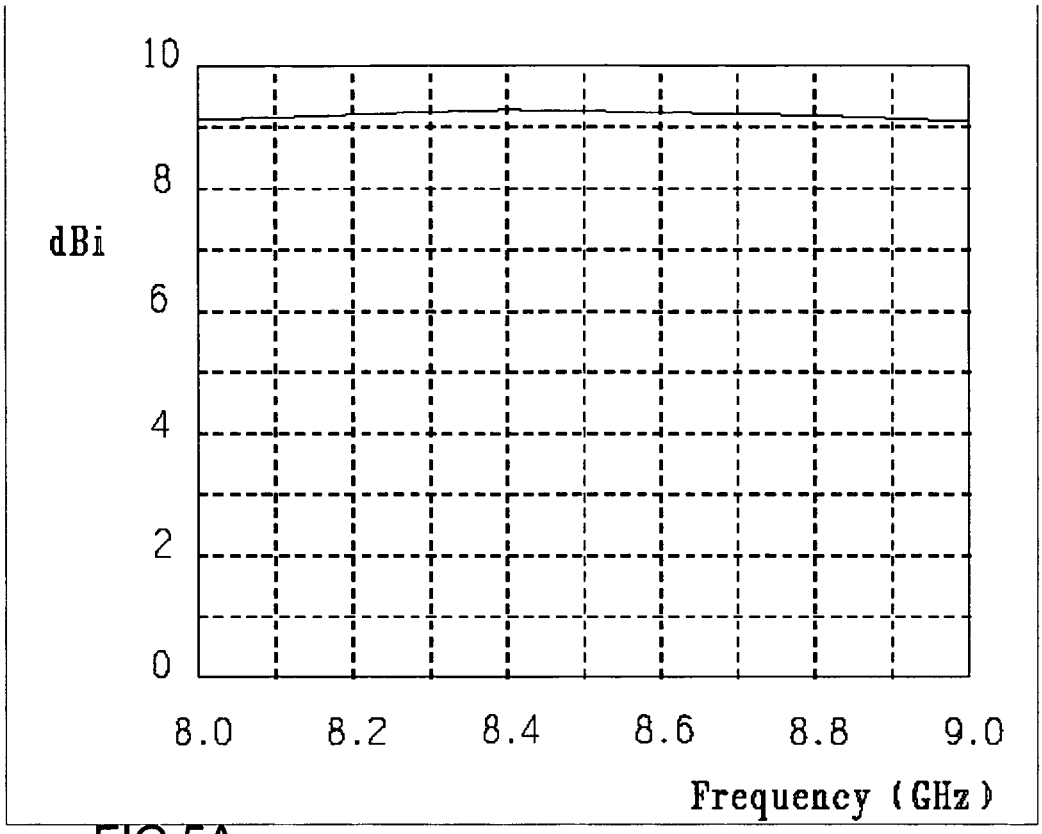
FIGS. 5*a*-5*e* illustrate simulated characteristics of an antenna element according to an embodiment of the invention.
Figure 5B:
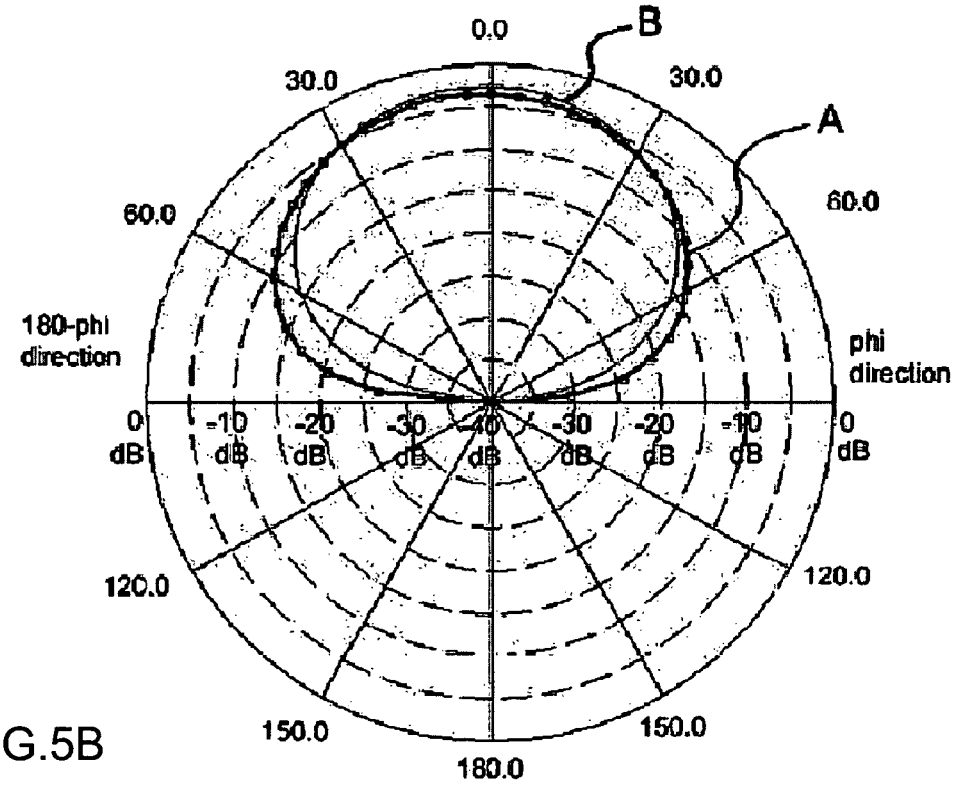
Figure 5C:
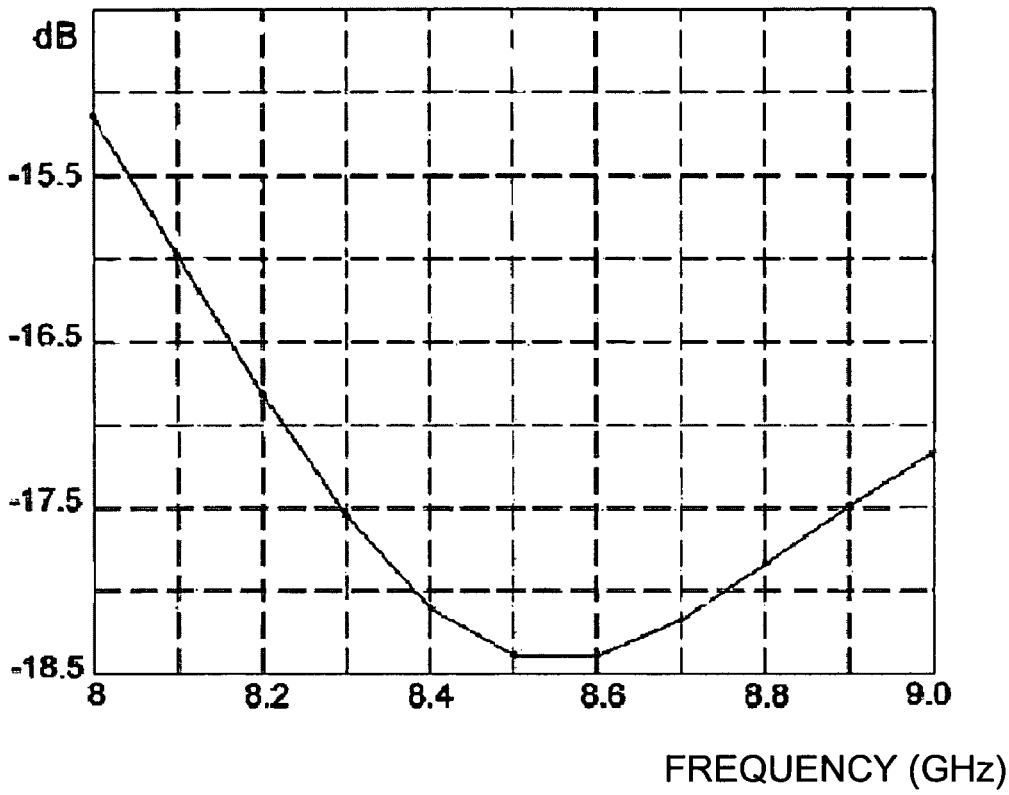
Figure 5D:
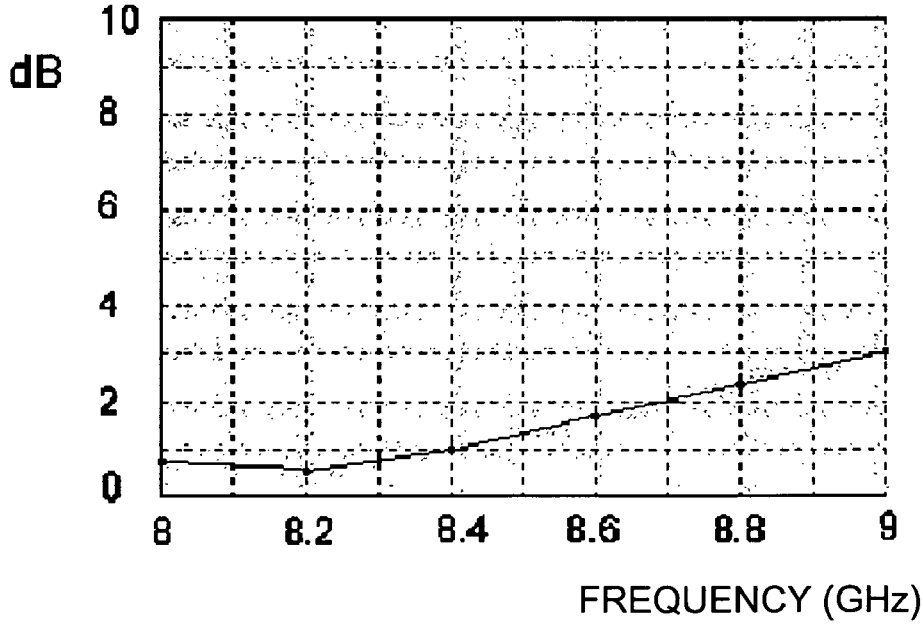
Figure 5E:
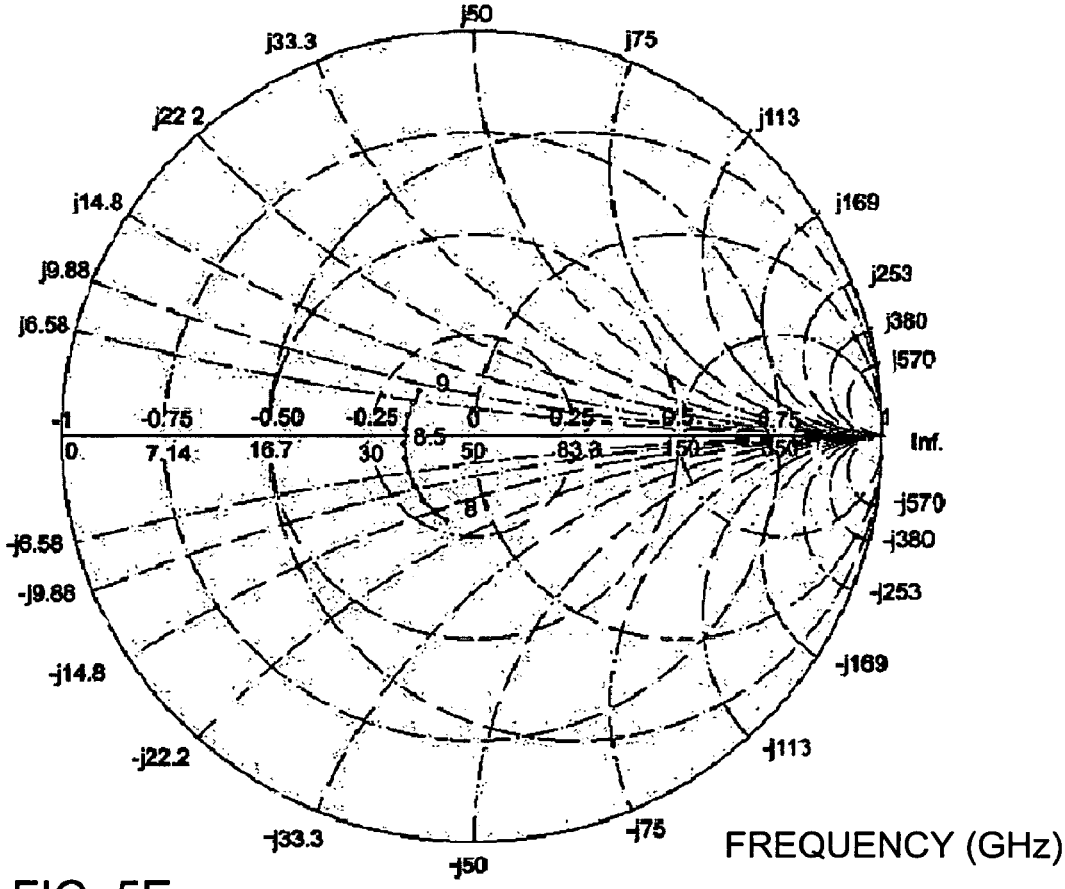

FIG. 5*a* shows the gain of a single pair of radiating elements. Note that typically the characterizing gain of prior art radiating elements having substantially the same geometrical dimensions as described above with reference to FIG. 3*a* is substantially up to 6 dB. FIG. 5*b* shows the simulated radiation pattern of the pair of radiating elements. Graph A represents the component $E_{phi}$ for phi=0° and graph B represents the component $E_{theta}$ for phi=0°. FIG. 5*c* shows the return loss in dB (the so-called $S_{11}$). FIG. 5*d* shows the axial ratio at (0,0)° (the so-called Broad side direction). FIG. 5*e* shows the so-called "Smith chart" of the input impedance.

According to yet another embodiment of the invention there is provided an antenna suitable for linear polarization. There follows a description of the design of a single radiating element as well as the paired radiating elements in the linear polarization configuration.

Figure 6:
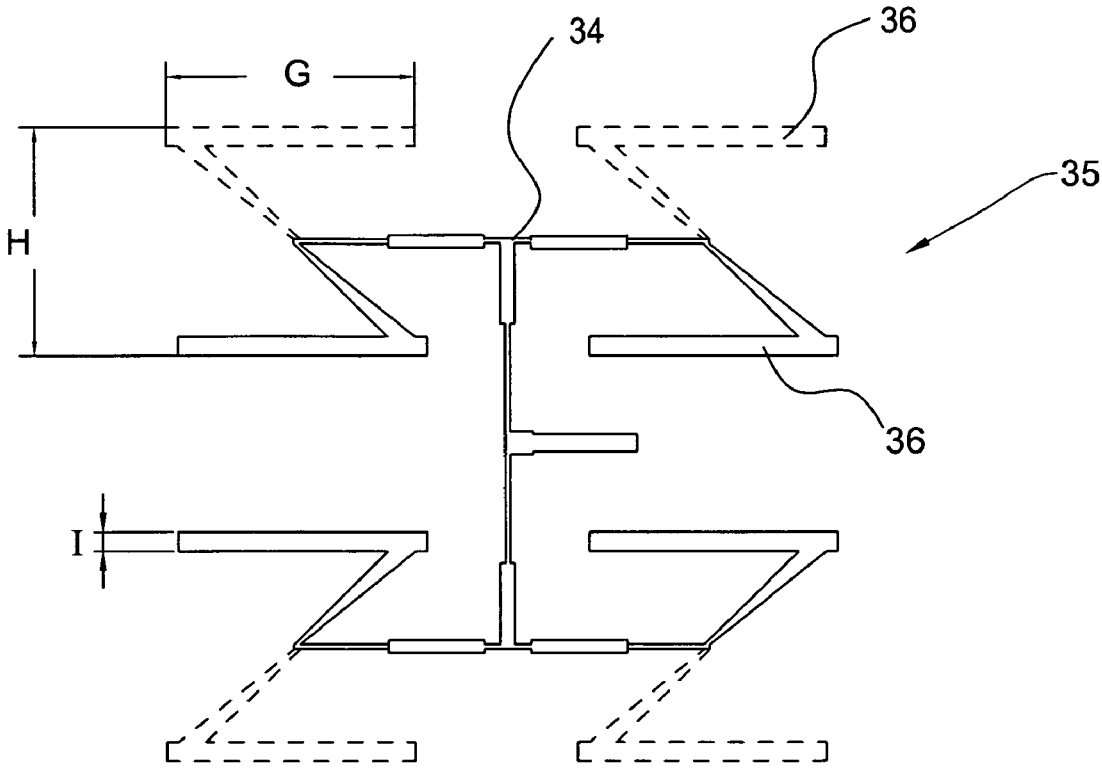
FIG. 6 is a schematic illustration of the structure of an element of an antenna according to another embodiment of the invention.

Reference is now made to FIG. 6, illustrating the structure of paired radiating elements 35 of an antenna according to an embodiment of the invention suited for linear polarization (horizontal or vertical, as the case may be) in operating frequency of 8 GHz. In the case of linear polarization, each of the upper and lower radiating elements 36 has bend-shaped elements having the shape of two-branches creating an acute angle between the branches. According to an embodiment of the invention the upper and lower radiating elements are relatively aligned such that the shape "Z" or "S" (or substantially such shape) is created, as shown in FIG. 6.

According to an embodiment of the invention, the radiating elements of the linear polarization configuration comprises bend-shaped elements having first and second branches arranged at an acute angle with respect to each other. The upper and lower radiating elements are arranged in a substantially symmetrical arrangement on both faces of the PCB, such that the first branches of the upper and lower elements are in parallel; and the electrical length of each of said first branches is about $0.5\lambda_0$, wherein $\lambda_0$ is the wavelength of said predefined frequency in air. In other words, each of the first branches of the upper and lower radiating elements, by itself, operates as a radiating element in linear polarization.

In the following example, the PCB material has relative permittivity $\in_r$=2.2 and width w=0.5 mm. Note that the invention is not bound by the following example. The geometrical dimensions of the acute-angled branches according to the following example are as follows:

The length G of the first branch is defined by the following equation:

$$G=K_5\lambda_0 \quad [7]$$

Wherein $K_5$ is in the range of 0.3 to 0.4, e.g. $K_5$=0.36, and wherein $\lambda_0$ is the wavelength of the operating frequency in air. Thus, in the abovementioned example (operating frequency of 8 GHz), G equals 13.5 mm.

The length H between the first branches of the upper and lower elements is defined by the following equation:

$$H=K_6\lambda_0 \quad [8]$$

Wherein $K_6$ is in the range of 0.3 to 0.35, e.g. $K_6$=0.32, and wherein $\lambda_0$ is the wavelength of the operating frequency in air. Thus, in the abovementioned operating frequency (8 GHz), H equals 12 mm.

The width I of the radiating element is defined by the following equation:

$$I=K_7\lambda_0 \quad [9]$$

Wherein $K_7$ is in the range of 0.015 to 0.025, e.g. $K_7$=0.02, and wherein $\lambda_0$ is the wavelength of the operating frequency in air. Thus, in the abovementioned operating frequency (8 GHz), 1 equals 1 mm. note that the invention is not limited by the specific example of FIG. 6.

Figure 7A:
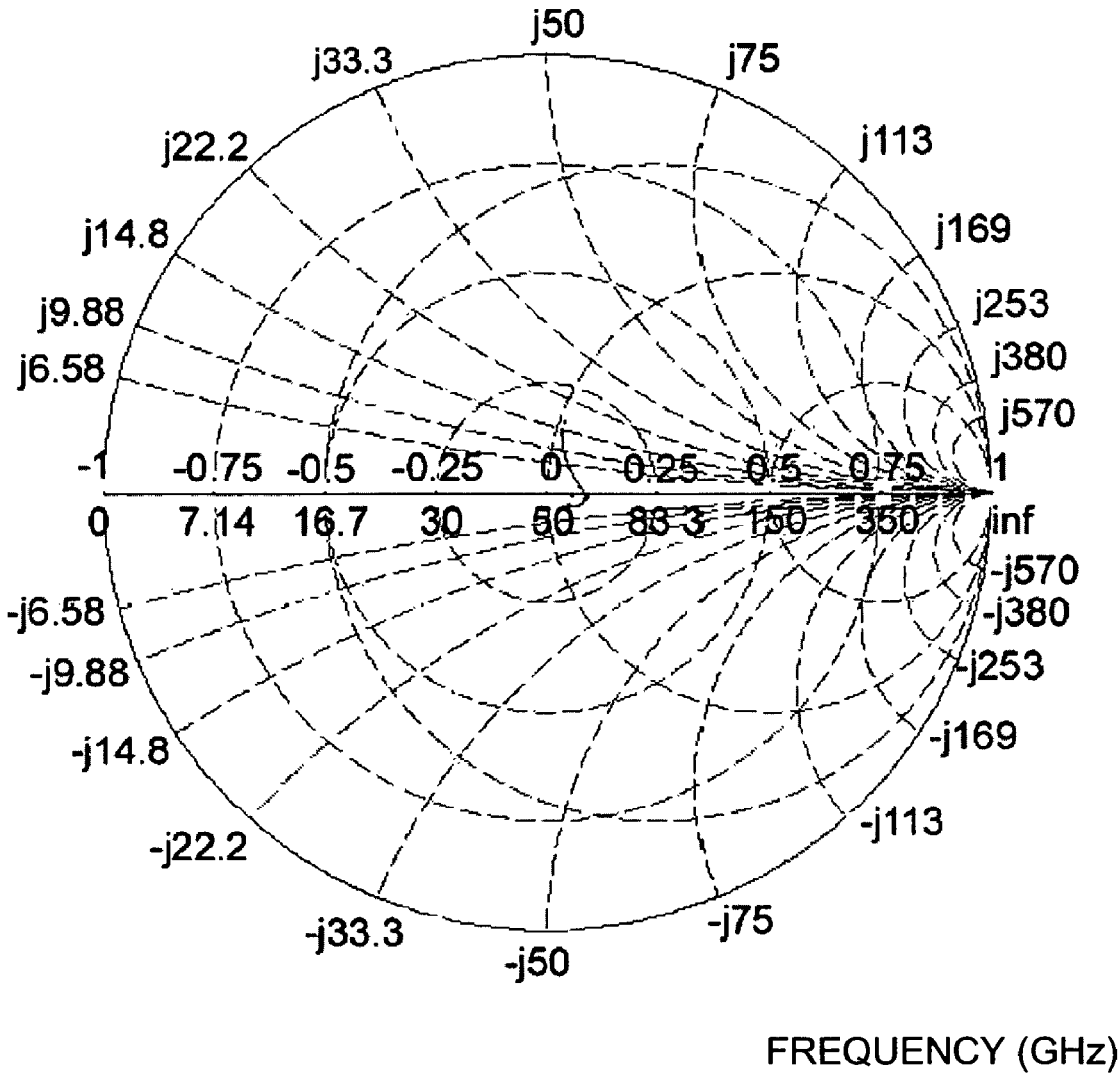
FIGS. 7*a*-7*c* illustrate simulated characteristics of an antenna element according to another embodiment of the invention.
Figure 7B:
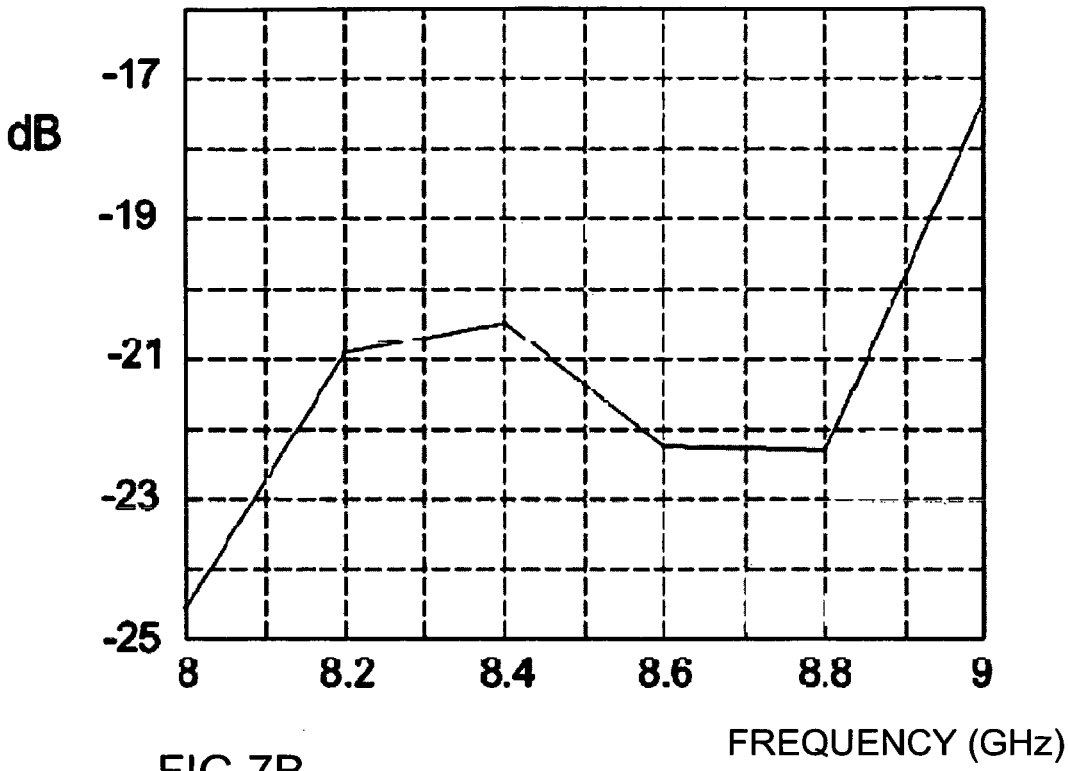
Figure 7C:
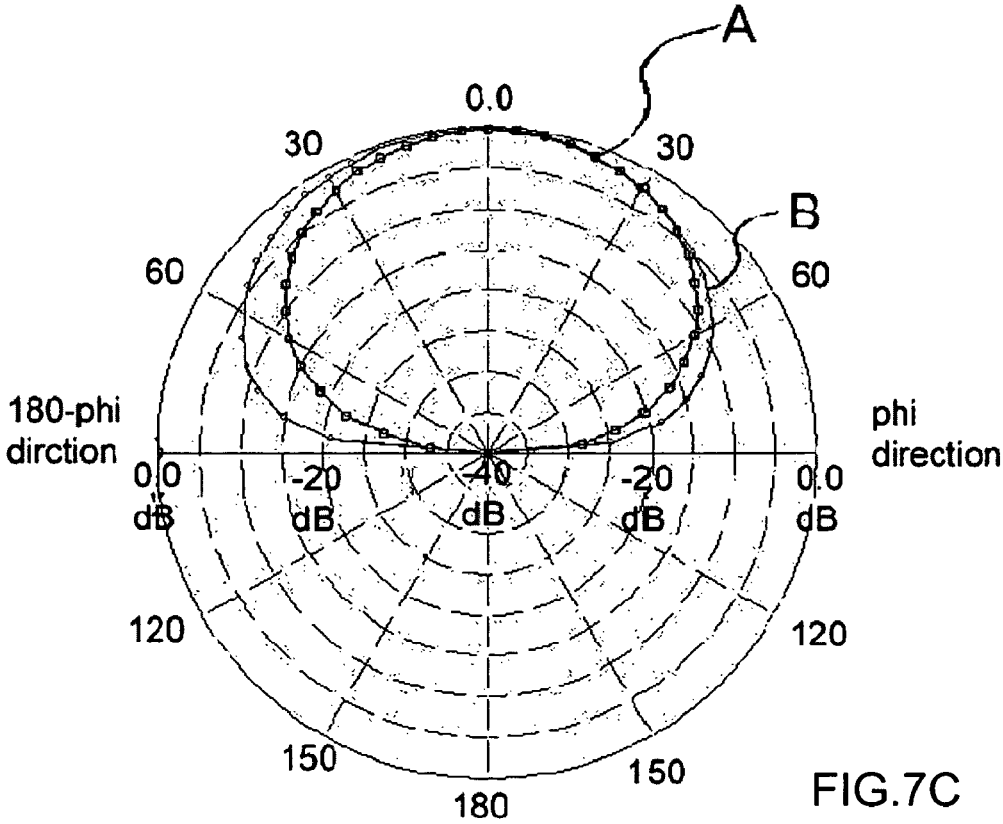

FIGS. 7*a*-7*c* illustrate simulated characteristics of an antenna paired element according to the embodiment of the invention shown in FIG. 6, in the operating frequency range of 8-9 GHz, as follows. FIG. 7*a* shows simulated input impedance of one paired element (the so called "Smith chart"). FIG. 7*b* shows the return loss in dB (the so-called $S_{11}$), of one paired element, in the frequency range of 8-9 GHz, and FIG. 7*c* shows the polar elevation pattern of the paired element at the frequency of 8.2 GHz. Graph A represents the component $E_{theta}$ for phi=90° and graph B represents the component $E_{phi}$ for phi=0°.

A variety of applications require various and sometime variable polarization. In the field of telecommunication, for example, data-link between ground stations and satellites is typically done with linear polarization, and sometime the polarization is required to vary, e.g. between −45 and +45 degrees with respect to the horizon.

Figure 8:
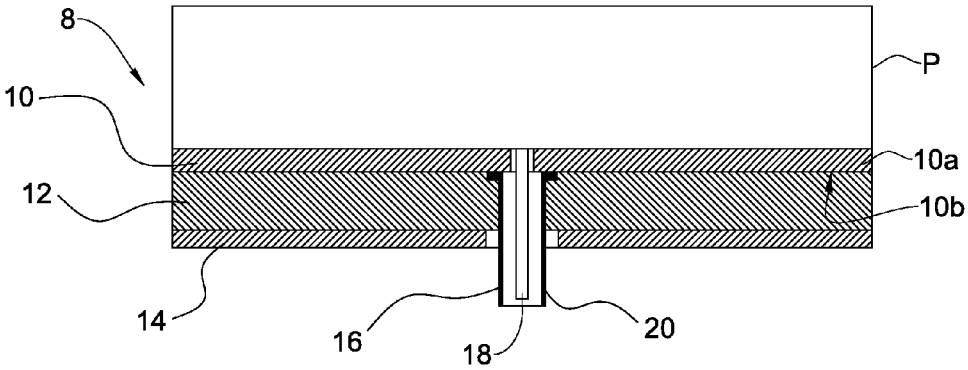
FIG. 8 is a cross-sectional view of a flat microwave antenna according to another embodiment of the invention.

According to an embodiment of the invention shown in FIG. 8, a polarizer is added to the antenna of the invention working in circular polarization (e.g. shown in FIG. 2), thereby transforming it to work in linear polarization. As shown, a polarizing layer P (a polarizer) is added to one side (e.g. the upper side) of a planar antenna of the kind described above with reference to FIGS. 3A and 3B (same numerals are used, referring to same elements). The polarizer is designed to cover substantially the entire upper surface of the antenna (in the xy plane shown in FIGS. 3A and 3B). The thickness of the polarizer has a typical value of about $0.5\lambda_0$ ($\lambda_0$ is the wavelength of the operating frequency in air), e.g. between 2 cm and 3 cm for frequencies of 8-9 GHz.

Covering entirely one face of the antenna with a polarizer P, has substantially no effect on the adaptation of the antenna. In the frequency range of 8 to 9 GHz, the return loss is substantially similar to the one shown in FIG. 5C. The measured pattern of the antenna exhibits a ratio of under −15 dB between the main and the cross polarization, along the frequency band. This means that a substantially correct transformation of the circular polarization to linear polarization is obtained. The measured gain of a single element (radiating element 21 shown e.g. in FIG. 3A, or other element e.g. as shown in FIGS. 4A-4D) presents a gain of 8 dBi and more. Note that by adding a polarizer to an antenna working in linear polarization, a transformation to work in circular polarization is achieved.

Figure 9A:
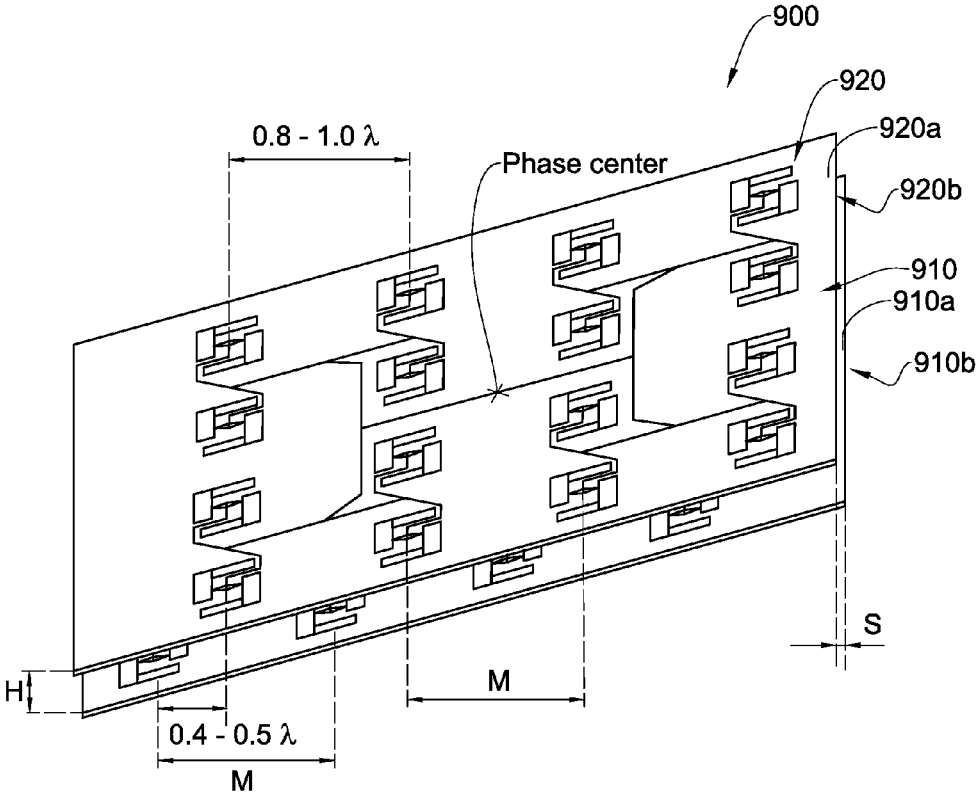
FIGS. 9*a*-9*c* are schematic illustrations of the structure of an antenna according to yet another embodiment of the invention.
Figure 9B:
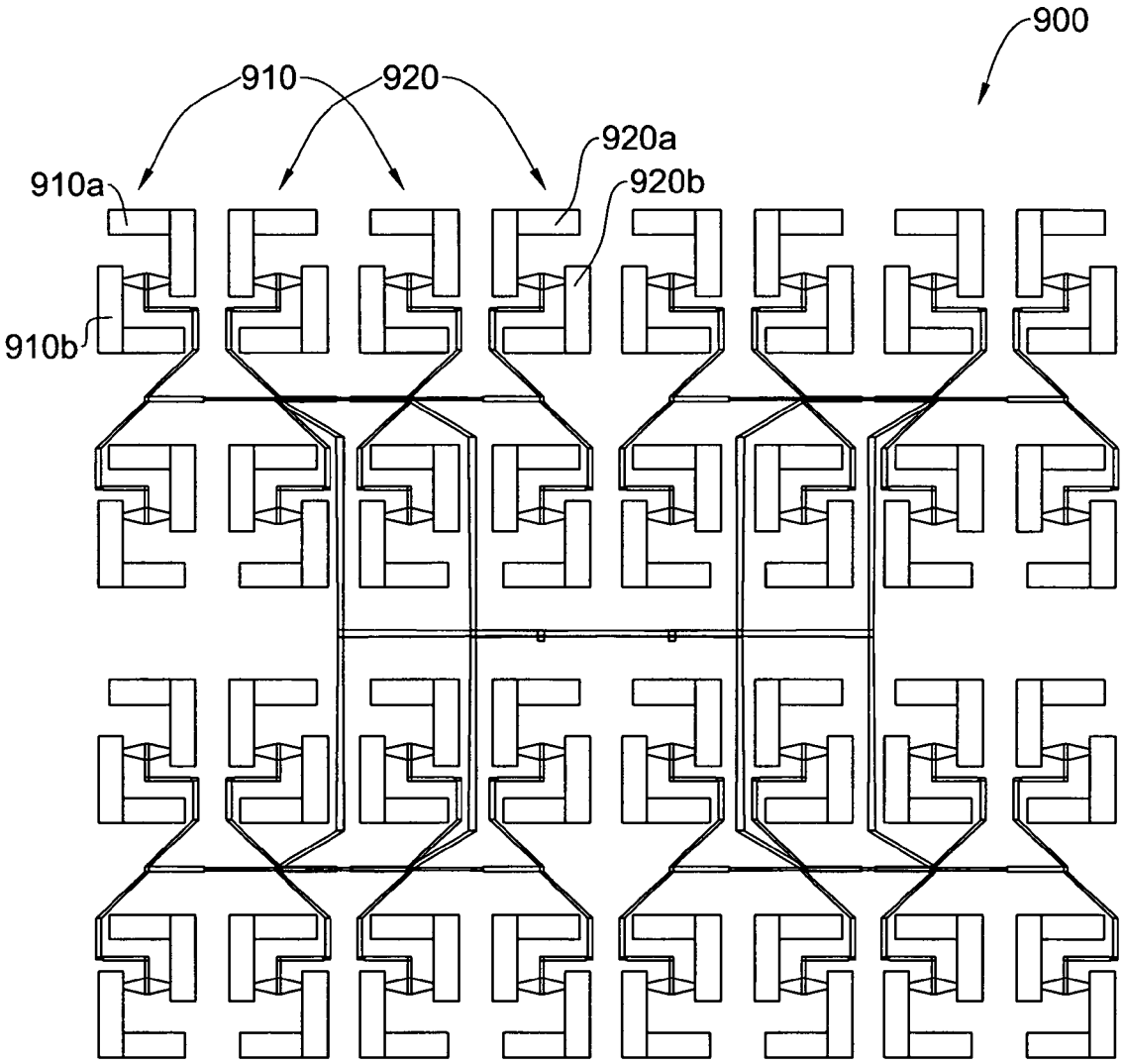
Figure 9C:
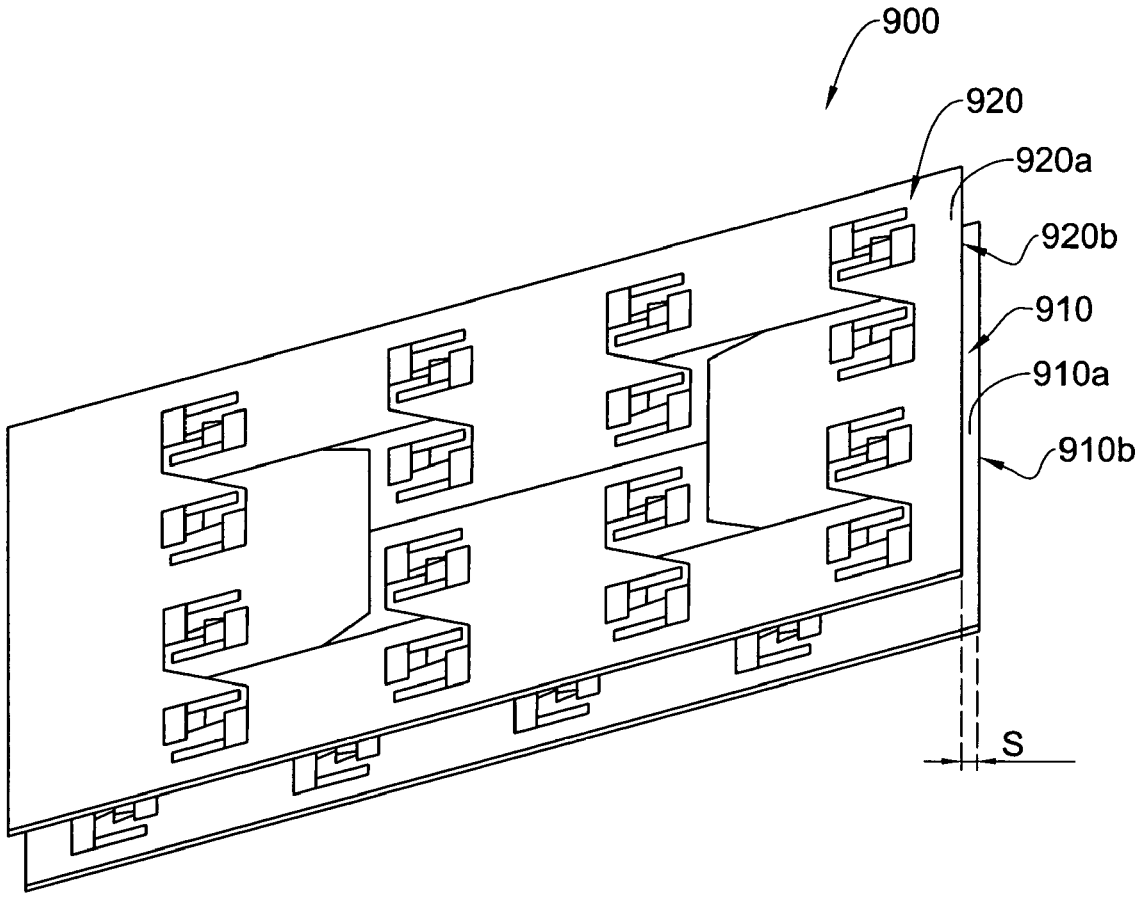

Referring now to FIGS. 9*a*-9*c*, there is presented, according to another embodiment of the invention, a variable polarization antenna. Variable polarization is achieved by combining right-hand and left-hand circular polarization (RCP and LCP, respectively) over the same area. Antenna 900 comprises PCB 910, which is of the kind described hereinbefore (e.g. element 10 shown in FIGS. 1, 2 and 3*a*). PCB 910 has two faces, 910*a* (upper face) and 910*b* (lower face), on which radiating elements of the present invention (e.g. elements 21 shown in FIG. 3*a*) are disposed, providing, as an example, right-hand circular polarization. PCB 920 is substantially identical to PCB 910 and is rotated by 180° to mirror PCB 910 (rotated with respect to axis Y shown in FIGS. 3*a* and 3*b*) and provides left-hand circular polarization. PCB 910 and 920 are spaced apart from one another by a small distance (H), e.g. $0.1\lambda_0$, providing a thin air layer for isolation therebetween.

In the resultant multi-layered antenna 900, the aperture of the antenna is shared by the superposition of the electromagnetic fields generated by the RCP and LCP printed circuits. According to another embodiment of the invention, a delay is provided between the ports (connectors) by a delay line or a phase shifter (not shown in FIGS. 9*a*-9*b*). This allows for affecting the summation pattern of the electromagnetic fields generated by the two printed circuits. When the summation is in phase, the overall linear polarization of the antenna is vertical. If a phase shift of 90 degrees is provided, the overall linear polarization of the antenna is horizontal. All the intermediate linear polarizations—between horizontal and vertical—can easily be obtained by adjusting the summation pattern e.g. by adjusting the length of the delay line or tuning the phase shifter. Thus, a single antenna can be easily adapted to support communication requiring various and variable polarization.

It should be noted that according to the present invention as described above, the radiation pattern of each of the radiating elements (elements 21 as illustrated in FIG. 3*a*) is equilibrated, due to the phase centers of the upper and lower elements being superimposed, thereby yielding high gain. If a different structure is used, in which the arms of the upper and lower elements do not overlap (i.e. the phase centers do not coincide), the resultant radiation pattern is dis-equilibrated, yielding relatively low gain. Therefore, in order to better the performance of such a structure, the elements need to be arranged such that mutual coupling between adjacent elements will not provide distractive influence.

According to an embodiment of the invention, the arrangement of the pairs of radiating elements disposed onto the same PCB is defined by the following equation:

$$M=K_8\lambda_0 \quad [10]$$

wherein $K_8$ is in the range of 0.8-1.0 and $\lambda_0$ is the wavelength of the operating frequency in air. Note that M defines the distance between the phase centers of adjacent paired elements on top of the same PCB.

According to the embodiment illustrated herein, the arrangement of pairs of radiating elements disposed onto different PCBs is defined by the following equation:

$$N=K_9\lambda_0 \quad [11]$$

wherein $K_9$ is in the range of 0.4-0.5 and $\lambda_0$ is the wavelength of the operating frequency in air. N defines the distance between the phase centers of associated pairs of elements—the RCP pair of elements and the LCP pair of elements, each disposed onto a different PCB. Hence, any change in the value of M will affect the superposition and the interference between the RCP and LCP waves.

This embodiment of the invention allows using two substantially identical printed antenna boards in combination, in an efficient manner, to provide over the same area right-hand or left-hand circular polarization, or both, as required.

As illustrated in FIG. 9*c*, according to another embodiment of the present invention, the radiating elements may be spaced apart onto PCBs 910 and 920, and PCB 920 may be somewhat shifted with respect to PCB 910 (shift S shown in FIG. 9*c*), such that destructive influence between elements of different layers (PCB 910, PCB 920) is prevented.

In the foregoing discussion, embodiments of the invention were presented with respect to a rectangular grid, e.g. as illustrated in FIG. 9*b*. It should be understood that the invention is not limited by the planar arrangement of elements on top of the PCBs, and other arrangements are possible.

Figure 10A:
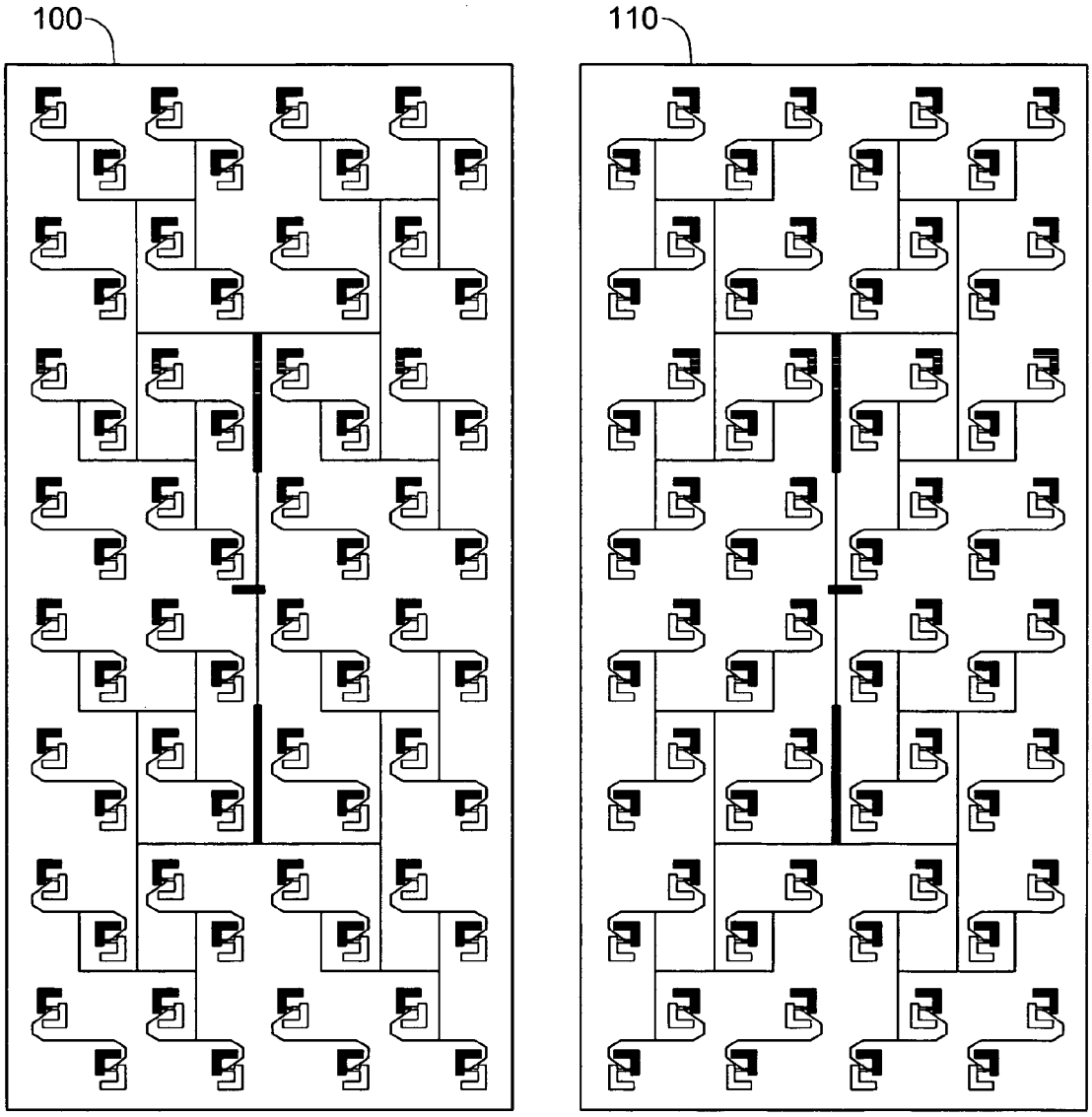
FIGS. 10*a*-10*b* illustrate another antenna according to another embodiment of the invention.
Figure 10B:
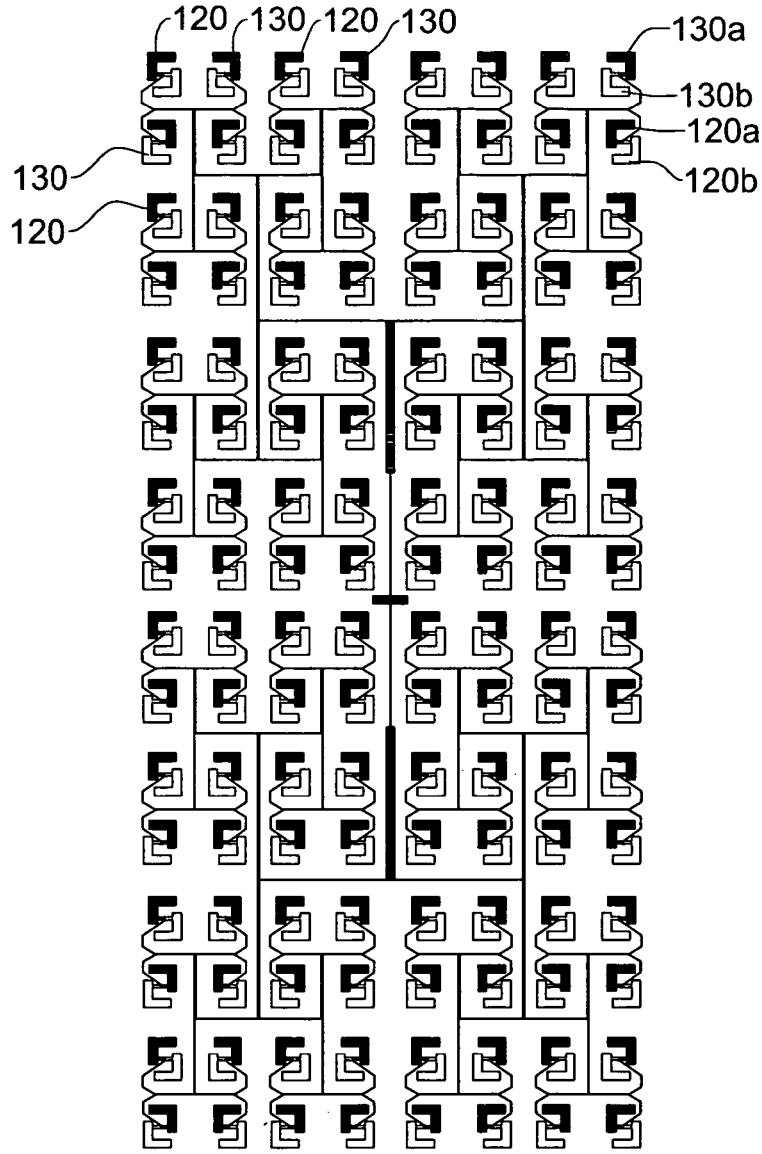

FIGS. 10*a*-10*b* illustrate another example of a combination of two substantially identical printed antenna boards according to another embodiment of the invention. In FIG. 10*a* there are shown two substantially identical printed boards 100 and 110. The radiating elements are arranged in a triangular grid. FIG. 10*b* illustrates a top view of the antenna, received by rotating board 110 and placing it on top of board 100. Radiating elements 120 are printed onto e.g. board 100, and radiating elements 130 are printed onto e.g. board 110. In the non-limiting example of FIGS. 10*a*-10*b*, elements 120*a* and 120*b* are printed onto the upper and lower faces of board 100, respectively; and elements 130*a* and 130*b* are printed onto the upper and lower faces of board 110, respectively. In this example, the phase centers of radiating elements 130*a* and 130*b* coincide, as well as the phase centers of elements 120*a* and 120*b*.

The invention was described in detail with reference to a planar configuration, in which the radiating elements are disposed onto both faces of a planar support. It should be noted that the invention is not limited by the above-described planar configuration and other arrangements are possible within the scope of the invention. For example, the invention can be implemented as a conformal antenna, which conforms to a surface whose shape is determined by considerations other than electromagnetic, for example, aerodynamic or hydrodynamic, or other non-planar configurations.

The invention was described in detail with reference to the operating frequencies falling within the range of 8-9 GHz. It should be noted that the invention is not limited by this specific example, and is suitable to operate in a variety of frequencies, with the necessary modifications and alterations, e.g. change of the operating frequency would result in change in the geometrical dimensions of the radiating elements and their respective planar layout and arrangement. The invention was described with reference to a printed configuration (utilizing a PCB), however it should be noted that the invention is not limited by this configuration. It should also be noted that in the range of relatively lower frequencies (e.g. 1 GHz and less), $\lambda$ equals 30 cm or more, thus allowing the use of radiating elements made of metal, as well as the use of air spacers, foam layers, etc. The invention was mainly described with reference to a single PCB configuration, in which the PCB has the radiating elements disposed on both its faces. It should be noted that the invention can be implemented in another configuration, in which two PCBs and more are adjacently used, each having the radiating elements disposed on one or both faces, such that the phase centers of adjacent radiating elements substantially coincide.

The invention was described with reference to a central feed scheme, in which all radiating elements printed over a certain area are fed via a common feed point. It should be understood that the invention is not limited by this example and other feed schemes are possible within the scope of the present invention. For example, by separating respective transmission lines over the same PCB, different radiating element pairs disposed over the same PCB could be operable with different polarization (e.g. some with RCP and some with LCP). Hence a single printed-board antenna made of circular polarization elements could provide linear polarization.

Figure 11:
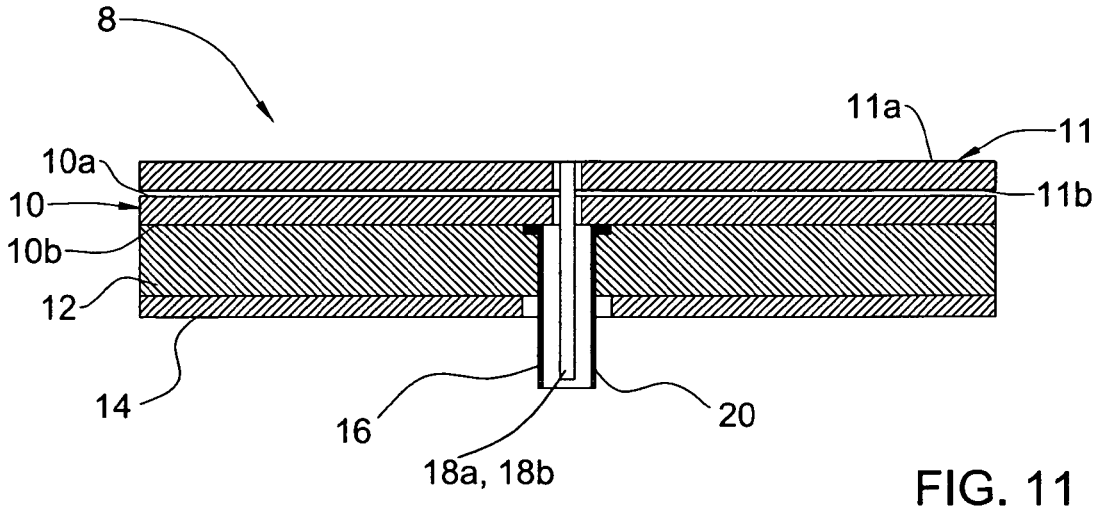
FIG. 11. is a cross-sectional view of a flat microwave antenna according to an embodiment of the invention.

FIG. 11. is a cross-sectional view of a flat microwave antenna according to certain embodiments of the invention, comprising two PCBs, 10 and 11. The PCBs carry the radiating elements whose phase centers coincide and are preferably spaced apart by no more than 0.1-0.2$\lambda_0$ wherein $\lambda_0$ is the wavelength of the operating frequency in air. Both PCBs carry radiating elements on their upper and lower faces (10*a*, 10*b*, 11*a*, 11*b*, respectively).

According to one embodiment of the invention, each PCB is fed via dedicated connectors (elements 18*a* and 18*b* in FIG. 11). According to one embodiment of the invention, each PCB carries radiating elements arranged substantially as illustrated in FIG. 2. Hence, each pair of radiating elements disposed on the upper and lower faces of one PCB is spatially associated with a substantially identical pair disposed on the upper and lower faces of the other PCB. The overall performance of the antenna is therefore increased.

According to another embodiment of the invention, each PCB carries radiating elements arranged substantially as illustrated in FIG. 9*a* or in FIG. 10*a*, and a delay between connectors 18*a* and 18*b* is provided (e.g. by a delay line or phase shifter, not shown in FIG. 11). As described above with reference to FIGS. 9*a*-9*c* and 10*a*-10*b*, by feeding one board with right-hand circular polarization and the other with left-hand circular polarization, various and variable linear polarization can be obtained. It should be understood that the invention is not limited by the arrangements illustrated in FIGS. 9*a*-9*c* and 10*a*-10*b*, and many others are possible within the scope of the present invention. For example, more than two printed boards could be used, non-identical printed boards could be used, and various feed schemes could also be used. Common to all possible arrangements is the requirement relating to the spatial disposition of radiating elements that are located over the same area portion onto different boards and/or faces: the phase centers of radiating elements that radiate electromagnetic field with the same characteristics (e.g. RCP, LCP) should coincide.

Thus, according to a first, broad aspect of the present invention, there is provided an antenna made of two or more spaced apart PCBs, each having one or more radiating elements disposed on one or both its faces, such that the phase center of at least one from among the plurality of radiating elements disposed on one face of a PCB coincides with a phase center of a radiating element disposed onto the other face of the same PCB or on a different, adjacent PCB.

According to another broad aspect of the invention, there is provided an antenna made of one or more PCBs, having one or more radiating elements disposed on one or both its faces, such that the phase center of at least one from among the plurality of radiating elements disposed on one face of the PCB coincides with a phase center of a radiating element disposed onto the other face of the same PCB or on a different PCB, thereby constituting a first pair of radiating elements. The antenna further comprises at least one second, substantially identical pair of radiating elements. The at least second pair is operable with a circular polarization different from that of the first pair (e.g. RCP/LPC), such that the aperture of the antenna is made of a superposition of electromagnetic fields corresponding to the first and second pair. The distance between the phase centers of the first and second pairs is preferably about 0.4$\lambda$ wherein $\lambda_0$ is the wavelength of the operating frequency in air.

It should be clear to anyone versed in the art that the reference to the second PCB as being 'substantially identical' to the first PCB excludes the portions of the PCBs onto which the connectors are located. This is illustrated e.g. in FIGS. 10*a*-10*b*: the central feed point of PCB 100 extends to a direction opposite to that of the central feed point of PCB 110. Put differently, the term 'substantially identical' when used to describe the similarity of the adjacent PCBs, describes the similarity in the planar arrangement of the radiating elements disposed onto the PCBs. In the embodiments illustrated in FIGS. 9*a*-9*c*, 10*a*-10*b* and 11, the connectors of both the first and second supports (PCBs) (elements 18*a* and 18*b* in FIG. 11) are placed beneath the PCBs, and therefore the PCBs are not identical in the area near the connectors. It should be understood that the invention is not limited to the illustrated configuration and other configurations are possible within the scope of the present invention, with necessary modifications and alterations.

The present invention has been described with a certain degree of particularity, but those versed in the art will readily appreciate that various alterations and modifications may be carried out without departing from the scope of the following Claims:

The invention claimed is:

1. An antenna for transmitting and/or receiving electromagnetic waves of at least one predefined frequency and a circular polarization, the antenna comprising:

a first support having upper and lower faces and at least one pair of substantially identical upper and lower radiating elements disposed on said upper and lower faces, respectively, each radiating element located on said upper face and each radiating element located on said lower face configured to transmit and/or receive electromagnetic waves of circular polarization by itself; and a second support substantially identical to the first support and spaced apart from the first support by about 0.1λ0-0.2λ0, λ0 being the wavelength of the predefined frequency in air.

2. An antenna according to claim 1 wherein the radiating elements are arranged in a rectangular grid or a triangular grid.

3. An antenna according to claim 1 wherein said second support is rotated by 180° to mirror the first support.

4. An antenna according to claim 3 wherein the radiating elements disposed on the first and second support are further capable of transmitting and/or receiving electromagnetic waves of a right-hand and a left-hand circular polarization, respectively, thereby in combination providing linear polarization.

5. An antenna according to claim 4 further comprising a delay unit coupled to the first and second supports for providing a predefined delay between electromagnetic waves transmitted and/or received from radiating elements disposed on the first support and the second support.

6. An antenna according to claim 5 wherein the delay unit is a delay line or a phase shifter.

7. An antenna according to claim 5 wherein the delay unit is capable of selectively change said delay thereby enabling variable linear polarization.

8. An antenna according to claim 1 wherein said radiating elements comprise bend-shaped elements.

9. An antenna according to claim 8 wherein said bend-shape elements have an L-shape.

10. An antenna for transmitting and/or receiving electromagnetic waves of at least one predefined frequency and a circular polarization, the antenna comprising:

a first support having upper and lower faces and at least one pair of substantially identical upper and lower radiating elements disposed on said upper and lower faces having phase centers located at predefined positions, respectively, where each radiating element located on said upper face and each radiating element located on said lower face is configured to transmit and/or receive electromagnetic waves of circular polarization by itself; and a second support substantially identical to the first support;

wherein the radiating elements on each face of said first and second supports are arranged such that the distance between the phase centers of at least two adjacent pairs located on the same support is in a range of 0.8λ0-1.0λ0, λ0 being the wavelength of the predefined frequency in air.

11. An antenna for transmitting and/or receiving electromagnetic waves of at least one predefined frequency and a circular polarization, the antenna comprising:

a first support having upper and lower faces and at least one pair of substantially identical upper and lower radiating elements disposed on said upper and lower faces having phase centers located at predefined positions, respectively, where each radiating element located on said upper face and each radiating element located on said lower face is configured to transmit and/or receive electromagnetic waves of circular polarization by itself; and a second support substantially identical to the first support;

wherein the radiating elements on each face of said first and second supports are arranged such that the distance between the phase centers of at least one pair located on the first support and another adjacent pair located on the second support is in a range of about 0.4λ0-0.5λ0, λ0 being the wavelength of the predefined frequency in air.

12. A method for providing a planar antenna for transmitting and/or receiving electromagnetic waves of at least one predefined frequency and a required linear polarization, the antenna having at least a first and second dielectric substrate, at least one face of each substrate carrying at least one radiating element configured to transmit and/or receive electromagnetic waves of circular polarization by itself with a phase center located at a predefined position, the method comprising:

pairing said radiating element with a corresponding, substantially identical radiating element carried on a different face, by having the phase center of the corresponding radiating element substantially coinciding with the phase center of said radiating element, thereby constituting an associated pair of radiating elements;

electronically associating said pair of radiating elements with at least one additional pair of radiating elements by determining the spatial arrangement of said pairs in accordance with said required linear polarization and said predefined frequency, such that the required linear polarization is obtained by assigning one pair with electromagnetic waves of right-hand circular polarization and the other pair with electromagnetic waves of left-hand circular polarization;

wherein said determining the spatial arrangement comprising at least one of the following:

spacing said first and second substrates by about 0.1λ0-0.2λ0;

on each support, arranging adjacent pairs of radiating elements such that the distance between the phase centers of the adjacent pairs is in a range of 0.8λ0-1.0λ0;

on each support, arranging adjacent pairs of radiating elements on a rectangular grid or a triangular grid; and arranging the associated pairs such that the distance between the phase centers of the associated pairs is in a range of 0.4λ0-0.5λ0, wherein λ0 is the wavelength of the predefined frequency in air.

13. A method according to claim 12 further comprising selectively providing a delay between the electromagnetic waves of right-hand circular polarization and the electromagnetic waves of left-hand circular polarization, thereby enabling variable linear polarization.

14. An antenna for transmitting and/or receiving electromagnetic waves of at least one predefined frequency and a circular polarization, the antenna comprising at least a first support having upper and lower faces and at least one pair of substantially identical upper and lower radiating elements disposed on said upper and lower faces, respectively, where each radiating element located on said upper face and each radiating element located on said lower face are configured to transmit and/or receive electromagnetic waves of circular polarization by itself.

* * * * *